US007168437B2

(12) United States Patent
Bigford

(10) Patent No.: US 7,168,437 B2
(45) Date of Patent: Jan. 30, 2007

(54) APPARATUS FOR ANCHORING AN UMBRELLA

(76) Inventor: Barbara Bigford, 3 Chetwynd Rd., Paoli, PA (US) 19301

( * ) Notice: Subject to any disclaimer, the term of this patent is extended or adjusted under 35 U.S.C. 154(b) by 378 days.

(21) Appl. No.: 10/733,993

(22) Filed: Dec. 10, 2003

(65) Prior Publication Data

US 2004/0118058 A1 Jun. 24, 2004

Related U.S. Application Data

(63) Continuation-in-part of application No. 10/238,158, filed on Sep. 9, 2002, now abandoned, which is a continuation of application No. 09/660,953, filed on Sep. 13, 2000, now Pat. No. 6,446,649.

(51) Int. Cl.
*A45B 3/00* (2006.01)

(52) U.S. Cl. ..... 135/16; 135/22; 135/25.1; 135/902; 248/519; 248/910

(58) Field of Classification Search ..... 135/16, 135/22, 25.1, 902, 25.31, 106, 15.1; 248/511, 248/519, 910
See application file for complete search history.

(56) References Cited

U.S. PATENT DOCUMENTS

| | | | |
|---|---|---|---|
| 2,883,247 | A | 4/1959 | Thompson |
| 3,340,919 | A | 9/1967 | Holbrook |
| 3,843,079 | A | 10/1974 | Reisling |
| 4,296,693 | A | 10/1981 | Archer |
| 4,546,730 | A | 10/1985 | Holland |
| 4,832,163 | A | 5/1989 | Levesque |
| 4,924,893 | A | 5/1990 | Furey |
| 5,143,108 | A | 9/1992 | Kenney |
| 5,207,406 | A | 5/1993 | Stine et al. |
| 5,288,150 | A | 2/1994 | Bearman |
| 5,323,802 | A | 6/1994 | Kiedrowski |
| 5,339,847 | A | 8/1994 | Kanter et al. |
| 5,427,346 | A | 6/1995 | Urgola |
| 5,452,877 | A | 9/1995 | Riffle et al. |
| 5,636,944 | A | 6/1997 | Buttimore |
| 5,823,213 | A | 10/1998 | Patarra |
| 5,899,044 | A | 5/1999 | Jarrett |
| RE36,262 | E | 8/1999 | Jondahl et al. |
| 6,061,850 | A | 5/2000 | Roper, III |
| 6,199,570 | B1 | 3/2001 | Patarra |
| 6,446,649 | B1 | 9/2002 | Bigford |

*Primary Examiner*—Jeanette E. Chapman
*Assistant Examiner*—Yvonne M. Horton
(74) *Attorney, Agent, or Firm*—Duane Morris LLP

(57) ABSTRACT

An apparatus for anchoring a device or for carrying articles on a device includes a ring structure and at least one container attached to the ring structure. The ring structure includes a container holder and a shaft holder. The at least one container is attached to the ring structure via the container holder.

13 Claims, 8 Drawing Sheets

APPARATUS FOR ANCHORING AN UMBRELLA

CROSS-REFERENCE TO RELATED APPLICATIONS

This application is a continuation-in-part of U.S. patent application Ser. No. 10/238,158 filed Sep. 9, 2002 now abandoned, which is a continuation of U.S. patent application Ser. No. 09/660,953 filed Sep. 13, 2000, now U.S. Pat. No. 6,446,649. The disclosure of U.S. Pat. No. 6,446,649 is hereby incorporated herein by reference in its entirety.

FIELD OF THE INVENTION

The present invention is directed to an apparatus for anchoring an umbrella. In particular, the invention is directed to an apparatus for anchoring an umbrella to the ground during outdoor use. The apparatus is applicable for anchoring a beach umbrella.

BACKGROUND OF THE INVENTION

Large umbrellas are commonly used at beaches and other outdoor recreational areas to provide protection from sun. At times, winds can topple or dislodge an umbrella. Attempts to remedy this problem include the use of spikes, threads or flanges to anchor the umbrella into the underlying surface. However, such structures may not be completely reliable in situations where winds are very high and/or the surface is of a consistency, such as fine and powdery, that does not attach securely to the structures.

Several other methods are available for anchoring umbrellas. For example, U.S. Pat. No. 5,452,877 discloses a beach umbrella anchor bag having a bottom opening. The bag is placed on an underlying surface with the bottom opening in contact with the underlying surface. The bottom opening allows an umbrella shaft or pole to be inserted therethrough into the underlying surface. The bag is filled with a material to provide weight, and attached to the umbrella shaft by panels of hook and loop material. One panel, e.g., the loop material, is affixed to the umbrella shaft with the loop surface exposed, and one or more panels of mating material, e.g., the hook material, are affixed to the bag. However, the bag is necessarily large and, if the opening in the bottom of the bag is sufficiently large, material that is inside the bag to provide weight may leak out, either gradually or suddenly if the umbrella is displaced such as by a strong wind.

U.S. Pat. No. 4,924,893 discloses a container in the form of a beach bag that is affixed to a beach umbrella by a flexible cable member to anchor the umbrella. The beach bag may be filled with sand to provide weight for anchoring the umbrella. If the bag has sufficient weight, the umbrella may be prevented from blowing away. However, the disclosure fails to show how the umbrella can be prevented by the bag from being toppled.

A need remains for methods and devices for anchoring umbrellas, particularly beach umbrellas, so that they remain substantially in a desired position when subjected to moderate winds.

SUMMARY OF THE INVENTION

According to one exemplary embodiment, an apparatus for anchoring a device or carrying articles on a device is disclosed comprising a ring structure and at least one container attached to the ring structure. The ring structure includes a container holder and a shaft holder. The at least one container is attached to the ring structure via the container holder.

According to another exemplary embodiment an apparatus for anchoring a device or carrying articles on a device is disclosed including a first and second ring and a container capable of being secure between the first and second ring. The first and second ring are capable of being secured on a shaft or pole.

According to a further exemplary embodiment, a system for anchoring a device or for carrying articles on a device is disclosed including a shaft, a ring structure secured to the shaft and at least one container attached to the ring structure. The ring structure includes a container holder and a shaft holder. The at least one container is attached to the ring structure via the container holder.

According to further exemplary embodiment, a method for anchoring a device or for carrying articles on a device is disclosed including providing a ring structure having a shaft holder and a container holder, attaching the ring structure to a shaft on the device via the shaft holder, and attaching at least one container to the ring structure via the container holder.

According to another exemplary embodiment, an apparatus for anchoring a device or for carrying articles on a device includes a ring structure and at least one container attached to the ring structure. The ring structure includes a means for attaching a container and a means for securing the ring structure to a shaft. The at least one container is attached to the ring structure via the means for attaching the container.

DETAILED DESCRIPTION

The present invention provides apparatuses and methods for anchoring an umbrella or other devices, such as tent poles, for example. The apparatuses are suitable for outdoor use on a beach or other recreational area, where an umbrella, or other device, having a central shaft that may be inserted into an underlying surface might be subjected to winds that could dislodge the shaft from the underlying surface. The apparatus described herein may also advantageously be used in other applications, such as for securing bags, sacks, or other carrying devices to apparatuses having a pole or pole-type element, for example, bed posts, strollers, chairs, and tables. The apparatuses include containers into which one or more substances or objects can be placed, to provide weight for anchoring the umbrella or tent, or to provide a means for carrying objects for convenience, such as when the apparatus is used on strollers or bed posts, for example.

Figure 1:
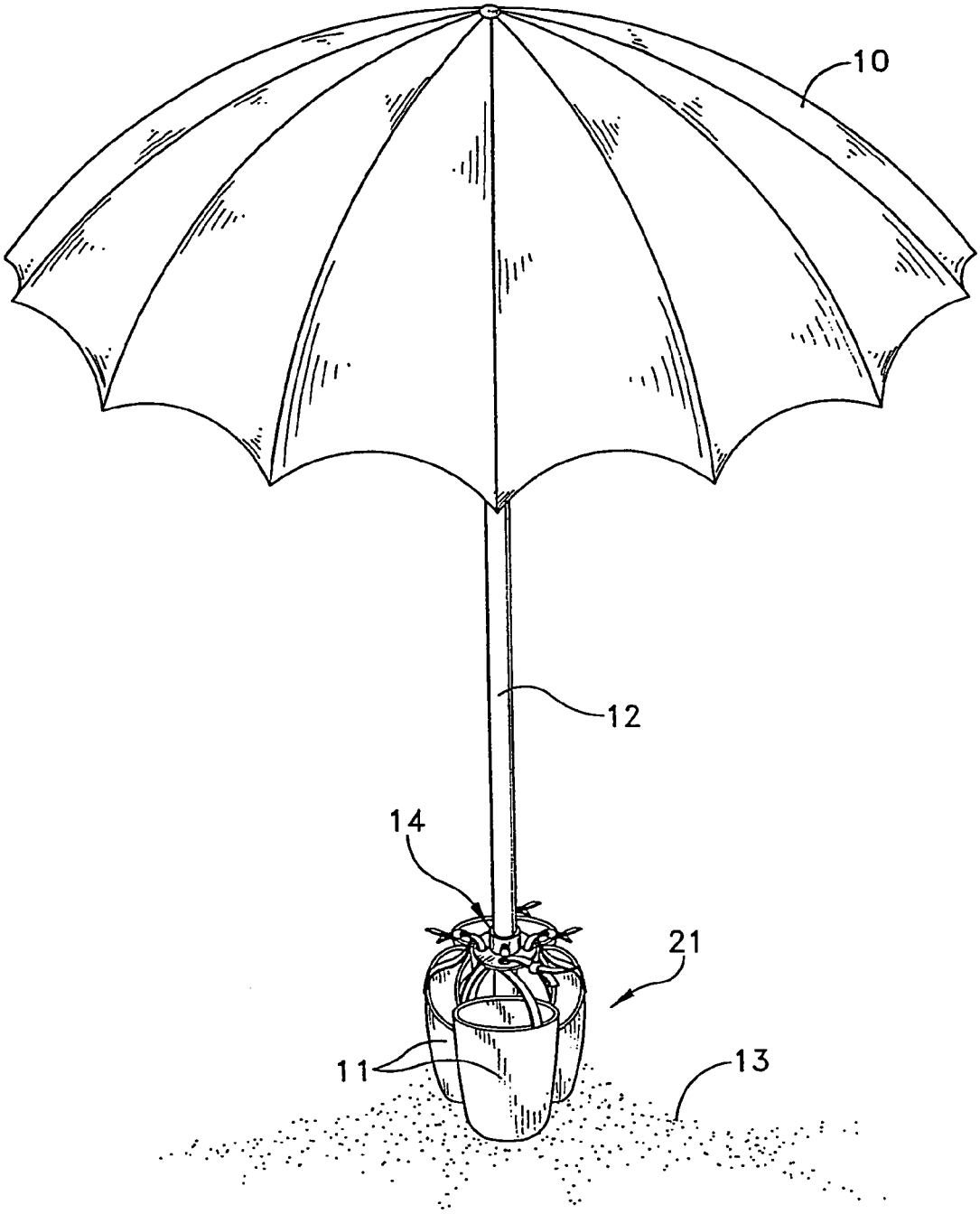
FIG. 1 shows a preferred embodiment of an apparatus for anchoring an umbrella as described herein. The apparatus is shown in place, attached to an umbrella.

Exemplary embodiments of the invention are now described in detail with reference to the Figures. (Although described with reference to a beach umbrella, the anchoring or carrying devices described herein may be used in conjunction with other articles, such as tent poles, bed posts, tables, and strollers, for example.) FIG. 1 shows an exemplary embodiment of an apparatus 21 in accordance with the present invention. Umbrella 10 has a central shaft 12 and is anchored by containers which, in the embodiment shown, are flexible containers in the form of bags 11, substantially filled with a material such as sand, to provide weight to the bags. In preferred embodiments, the bags and the material contained therein together have a weight about equal to or greater than the weight of the umbrella 10, more preferably equal to or greater than the combined weight of the umbrella 10 and the shaft 12.

The umbrella shaft 12 is inserted into the underlying surface 13, which may be sand or earth. The depth to which the umbrella shaft 12 is inserted is not critical; however it is generally preferred that the umbrella shaft be inserted to a depth such that resistance is met when an attempt is made to remove the umbrella shaft from the underlying surface 13. For example, the shaft 12 may be inserted into the underlying surface 13 to a depth of about 6, 12, 18, or 24 inches or more. It is not necessary that the umbrella shaft 12 have any auxiliary structures spikes, threads, flanges or other structures thereon, to supplement the anchoring of the umbrella due to the bags and the material contained therein. The absence of such auxiliary structures may be preferred for safety or ease in handling. However, umbrellas having such auxiliary structures are within the scope of the invention.

Substances that can be placed inside the containers 11 to provide weight include, for example, inorganic materials such as sand, dirt, rocks, and pebbles. If the containers are able to hold liquid, e.g., if the containers are buckets, water or other liquid can be placed inside the containers. Also, if desired, one or more of the containers can be used to transport articles such as shoes, toys, beverages, and the like to a beach or recreational area, and the containers can be filled with sand or other materials when the articles are removed. In particularly preferred embodiments, when the apparatus is used at a beach to anchor a beach umbrella 10, sand can be placed into one or more of the containers 11 when the umbrella is placed into position on the surface 13 of the beach, which alleviates the necessity to carry to the beach any materials or objects to provide weight to the containers.

The containers 11 can be flexible containers made of any material that is able to be folded or compressed for carrying or storage, and able to substantially resume its initial shape. Examples of materials suitable for flexible containers 11 include woven or non-woven fabric, including canvas and cotton fabrics; polymeric materials, particularly plastics such as polyethylene; and woven or non-woven fabric coated with plastic or other polymeric materials. Preferred fabrics include polyester fabrics and nylon, with rip-stop nylon being a highly preferred nylon. In some highly preferred embodiments, the flexible containers are made of coated or extra-strength rip-stop nylon fabrics, such as fabrics used in making parachutes. Such fabric, known as "parachute cloth" or "parachute fabric", provides advantages of strength, durability, and substantial impermeability, without eliminating flexibility. Such fabrics are commonly referred to as "zero-porosity" fabrics because they exhibit minimal permeability to air, which is highly desirable in fabrics used for parachutes. In the exemplary apparatus 21, such "zero-porosity" fabrics or fabrics having similar properties are desirable because they can hold sand or other materials with minimal or no leakage of the material. Such fabrics are generally stronger than conventional synthetic fabrics, and may have tear strengths of 5, 10, 15, 20 or more pounds, even up to about 50 pounds. Also, parachute fabrics generally have a porosity to air of less than about 13 cubic feet per minute. However, while fabrics meeting criteria of strength and porosity suitable for use in parachutes may be advantageous for flexible containers of the apparatuses described herein, such criteria are generally not required and conventional synthetic fabrics such as rip-stop nylon or polyester can be used, for example.

In other embodiments, one or more, or all, of the containers may be made of a rigid or semi-rigid material such as plastic or even metal. Examples of such containers include buckets.

Figure 4:
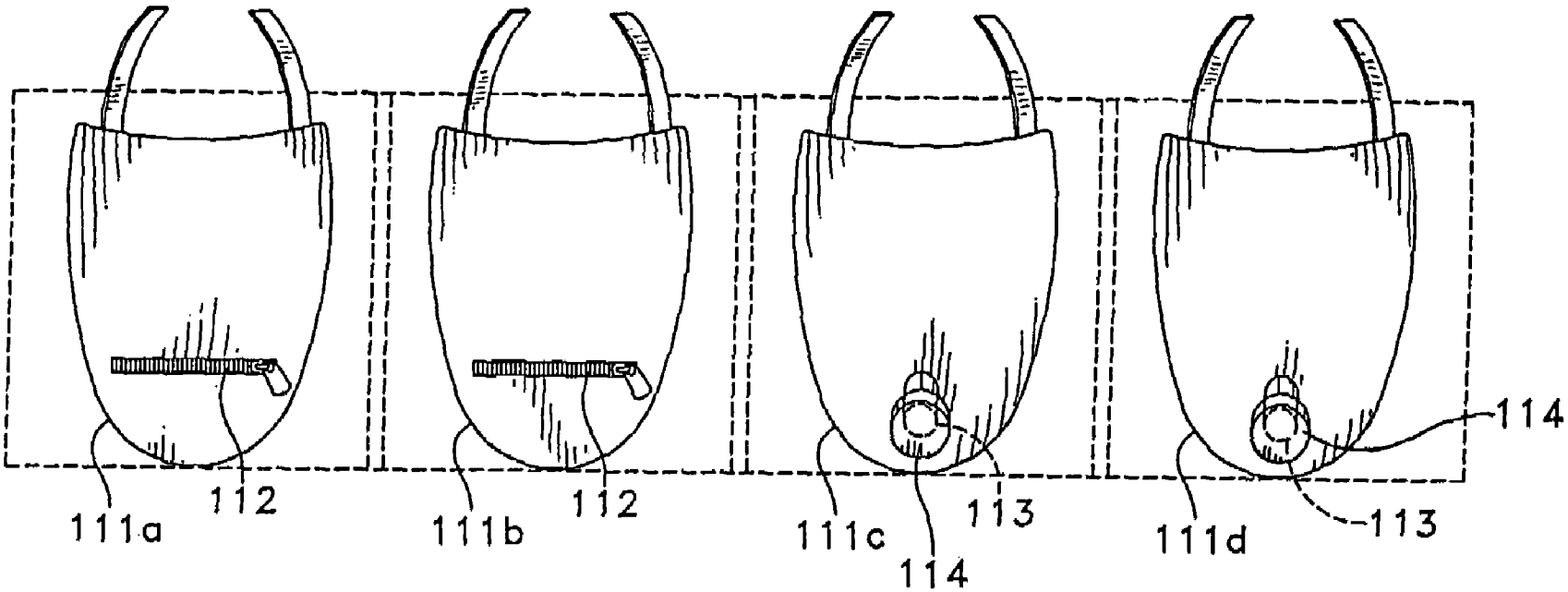
FIG. 4 shows a variation of the container assembly of FIG. 1.

Having a plurality of containers 11 allows a user to modify the amount and distribution of weight of material placed into the containers. Also, in contrast to the anchoring device described in U.S. Pat. No. 5,452,877, the plurality of containers 11 used in the apparatus described herein can be placed upright, i.e. with an opening for placing material into the containers disposed at the uppermost portion of a container rather than at the bottom of the container as described in the '877 patent. Having an opening at the top of a container rather than the bottom can minimize or eliminate leakage of material from the container. Furthermore, the container can be inverted to empty out material such as sand from the container, for example, in preparation for transport of the umbrella after use. Optionally, as shown in FIG. 4, each container may have a sealable opening at its bottom, sealed by, for example, a zipper 112, plug, or spout 113 having a screw-off cap 114. Such a bottom opening can be used to empty out sand or other material from the container.

The size and number of containers is not critical. However, it has been found that 3 to 5 containers, especially 3 or 4 containers, may be advantageous if the containers are sized such that they can hold up to about 2 liters. For example, containers in the form of bags and large enough to hold an average pair of adult's shoes are particularly suitable. Larger containers, such as containers capable of holding 3, 4, or 5 liters may be used if desired. Preferably, the containers 11 are capable of arrangement so as to surround and engage the umbrella shaft 12 substantially evenly about the shaft, to provide improved stability.

The containers 11 are removably attached to a ring 14 which may be formed of a deformable material, and which is disposed about the shaft of the umbrella. "Deformable material" means a material that has a relaxed configuration and can undergo deformation to a stressed configuration, for example, by stretching. Examples of suitable deformable materials include natural and synthetic rubbers, silicone polymers, and plastics.

Figure 2A:
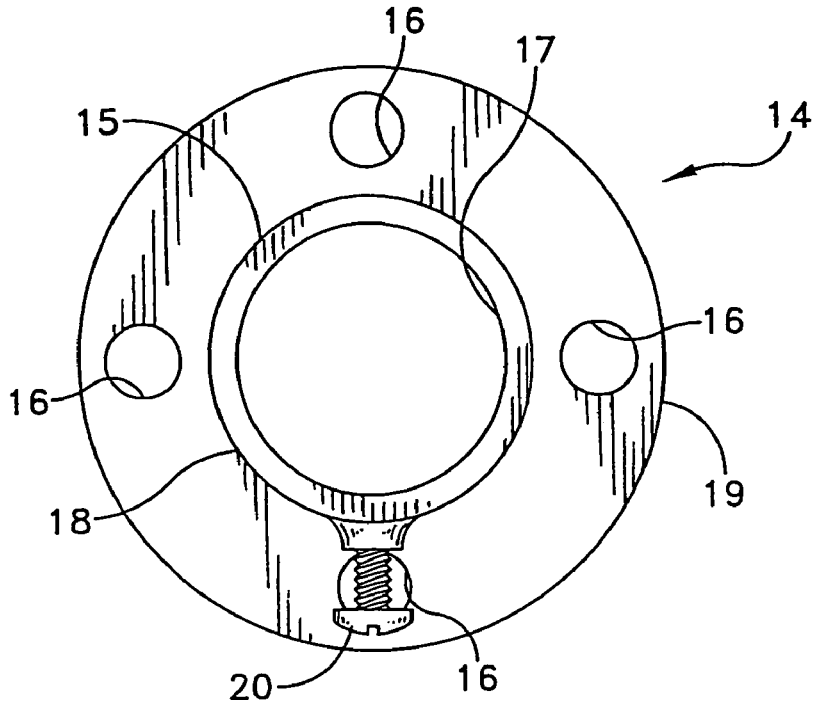
FIG. 2(*a*) is a top plan view and FIG. 2(*b*) is a perspective view of an attachment ring for attaching an apparatus to an umbrella.
Figure 2B:
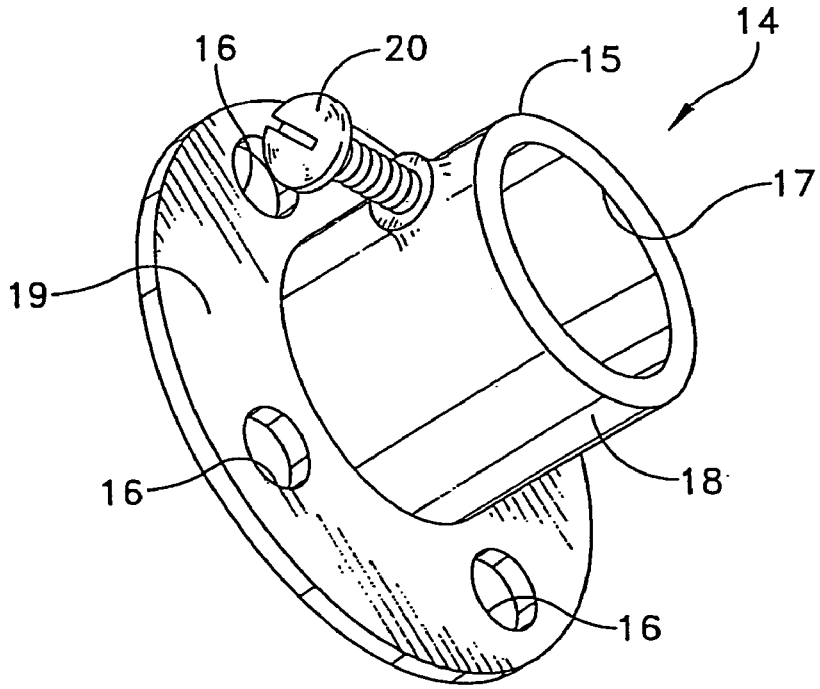

FIG. 2(*a*) is a top plan view and FIG. 2(*b*) is a perspective view of a ring 14 for use in an exemplary embodiment of the invention. In the embodiment shown in FIGS. 2(*a*) and 2(*b*), the ring includes a substantial circular body 15, flange 19, apertures 16, inner surface 17 and outer surface 18. The inner surface 17 is disposed adjacent to the umbrella shaft and the outer surface 18 is disposed away from the umbrella shaft when the ring is in place on the umbrella shaft as in FIG. 1. The ring 14 preferably has an adjustable inner diameter, such that the inner diameter can be made substantially equal to the outer diameter of the umbrella shaft 12. In the exemplary embodiment shown, set screw 20 provides adjustment of the inner diameter of the ring 14, and functions to secure the ring to the umbrella shaft. Alternatively, adjustment of ring diameter may be provided in other ways known to those skilled in the art, including the use of clamps. The ring of this embodiment, or any of the embodiments described herein, may be secured to the shaft using other shaft securing means, including, for example, Velcro, adhesives, a pin or peg, or other fastener capable of securing the ring to the shaft.

Figure 6:
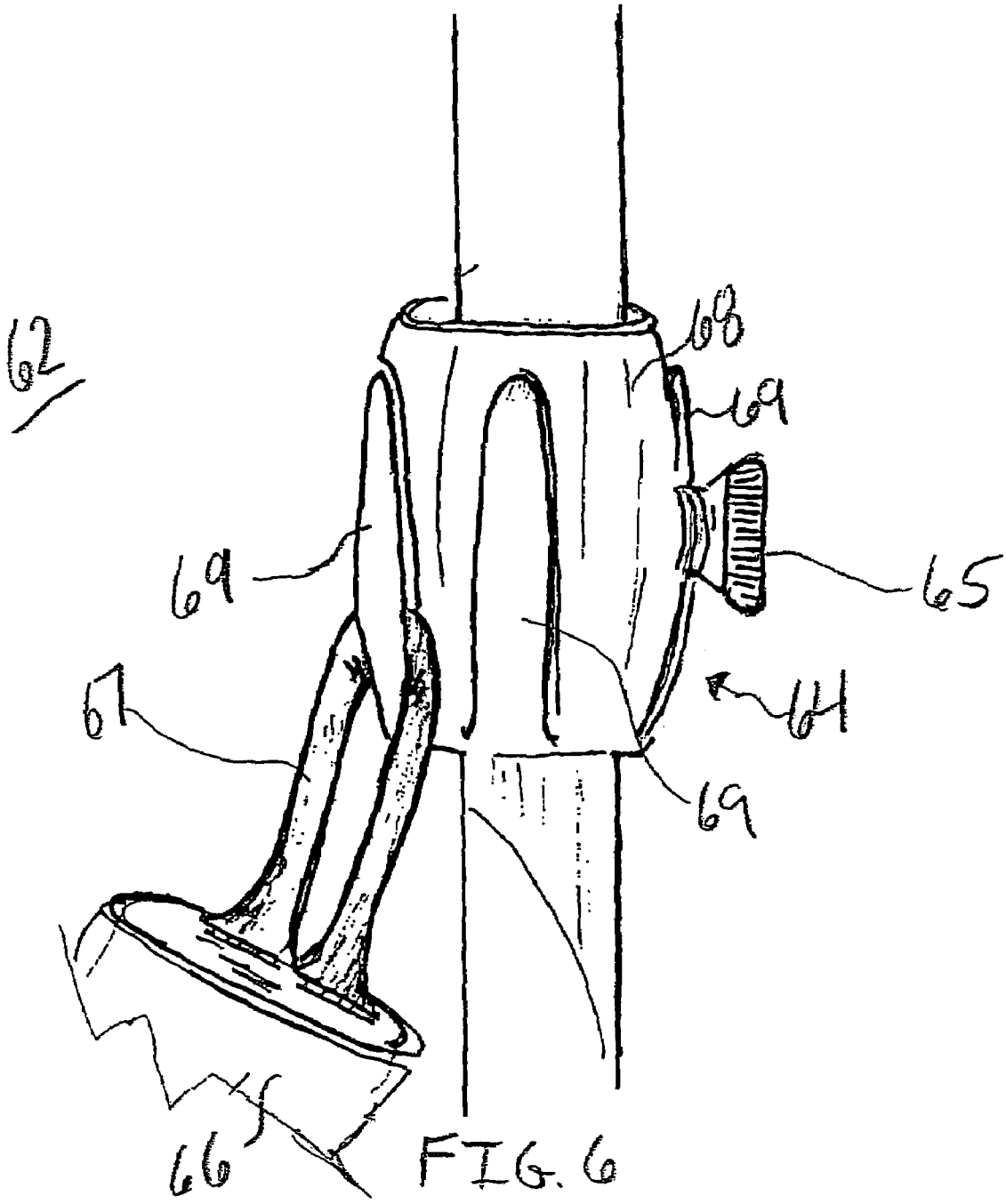
FIG. 6 is an isometric view of an apparatus for anchoring a device or carrying articles according to another exemplary embodiment.

The ring 14, including the circular body 15 and flange 19, may also be made of a rigid or semi-rigid plastic, such as polyethylene; or other rigid or semi-rigid materials such as aluminum, polycarbonate, steel or a composite material. The ring may have a variety of shapes. In one preferred embodiment as shown in FIG. 6, the ring is substantially barrel-shaped. Further, the ring may be formed from a single piece of material or may be formed of separate pieces which are connected together. For example, the ring may be comprised of two pieces, or halves, which are capable of connecting together to form a unitary ring structure (e.g., two halves of a barrel or tube-shaped ring structure which can be slid together on the pole and attached via tracks or other connecting mechanism).

In other embodiments, ring 14 may comprise two concentric substantially circular rings, namely an inner ring (not shown) and an outer ring, substantially in the form of circular body 15. The outer ring may have a recession (not shown) on its inner surface 17 such that the inner ring may be engaged with the outer ring by fitting the inner ring into the recession. The inner ring is made of a deformable material, and the outer ring may be made of any material that can be configured into a ring with apertures 16. For example, the outer ring may be made of a rigid plastic, a metallic substance, or a composite. The outer ring may have an adjustable diameter so that it may be compressed about the umbrella shaft and the inner ring. The inner ring provides a friction seal between the ring and the umbrella shaft.

Figure 3:
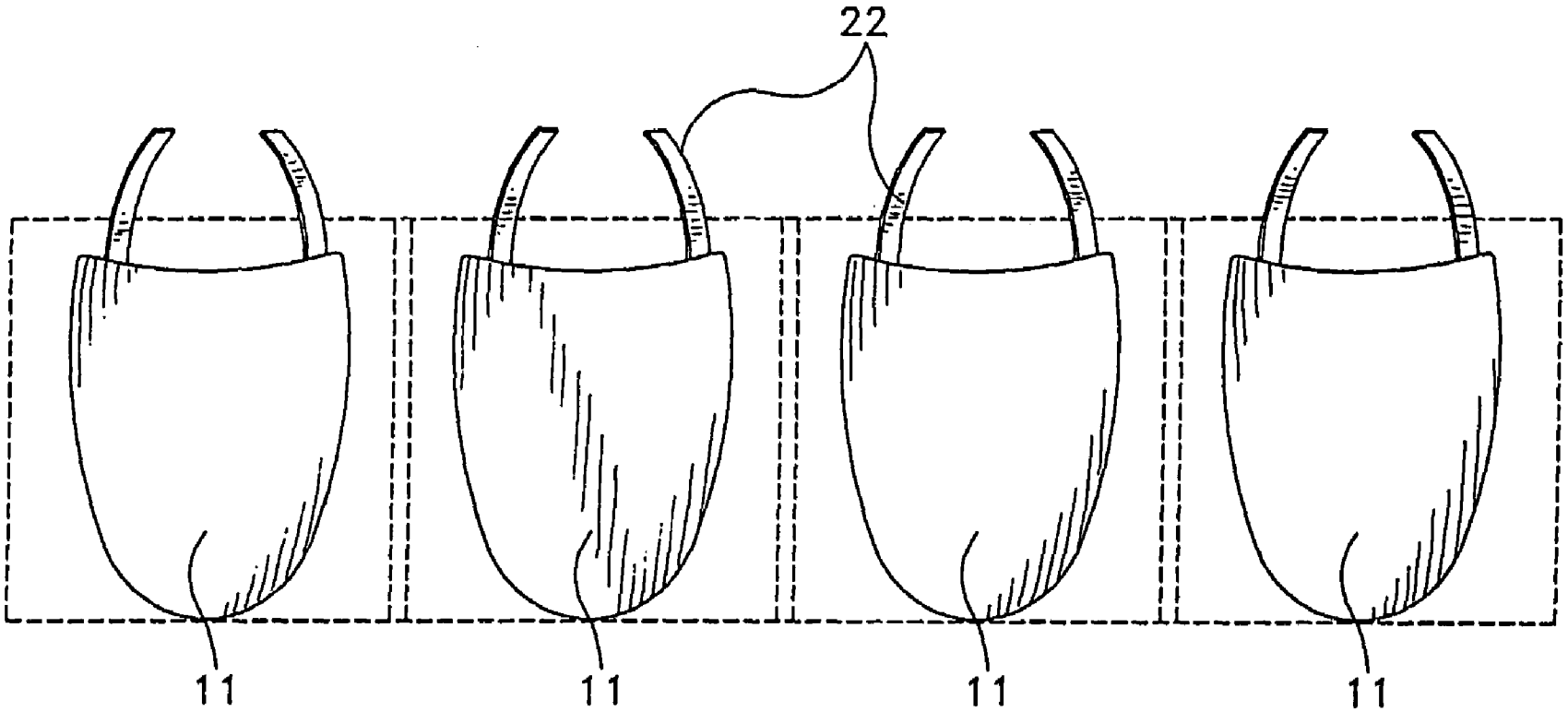
FIG. 3 shows the container assembly of FIG. 1, unfolded in a flat configuration.

Attachment of the containers 11 to the ring 14 may be facilitated, for example, by extensions 22 of the fabric or other material of which the containers are made. Such extensions 22 may be long enough to be drawn through the ring and tied, as shown in FIG. 3. Alternatively, attachment means such as snaps, buttons, or hook-and-loop closures can be affixed to the extensions and used to attach the containers 11 to the ring 14. When the containers are buckets, bucket handles may function to attach the containers to the ring.

FIG. 3 shows four flexible containers 17 suitable for use in preferred embodiments of the invention. Each container 11 has two extensions 22 in the form of ties. Ring 14 is slid onto the umbrella shaft 12 and located at a desired height. The extensions 22 can be drawn through apertures 16 on ring 14 and tied.

Thus, for example, in comparison to the apparatus disclosed in the '877 patent, the umbrella 10 is less likely to be lifted away from the containers by a gust of wind because the friction seal between the ring and the umbrella shaft can resist upward motion of the umbrella.

In alternative embodiments, the ring may be made substantially entirely of a deformable material such as rubber. A ring made of a deformable material may have, in a relaxed configuration, a diameter substantially equal to the diameter of the umbrella shaft. If the ring forms a friction seal with the umbrella shaft, the ring may not have an inner diameter that is adjustable by an auxiliary means such as a set screw or clamp. The ring may have apertures therein for receiving extensions of containers 11. The ring may also include other types of container holders, including clips and hooks (as described below), or other means for attaching the container, including, for example, Velcro, adhesives, or any other fastener capable of securing the container to the ring.

Figure 5:
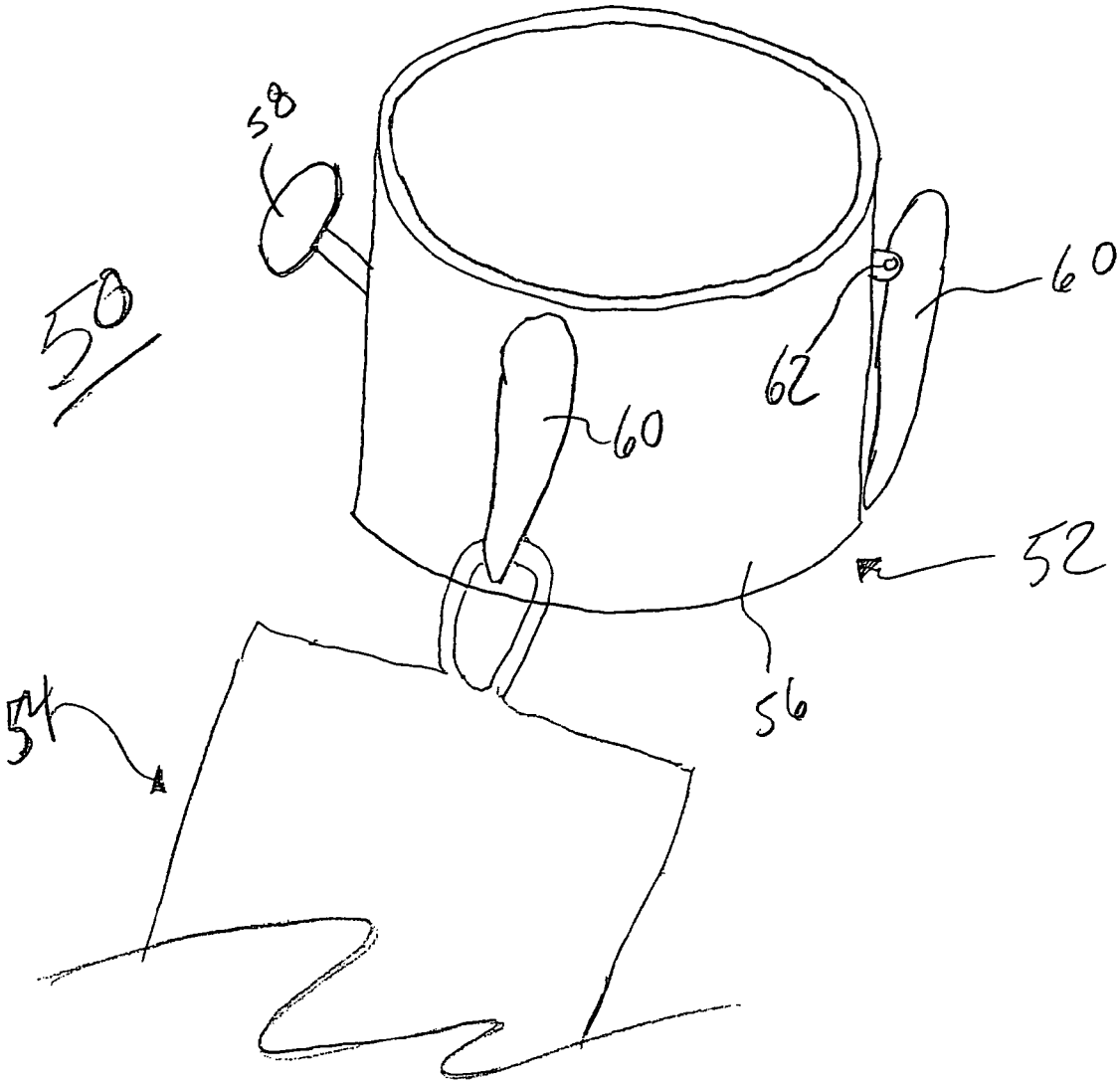
FIG. 5 is an isometric view of an apparatus for anchoring a device or carrying articles according to another exemplary embodiment.

Referring now to FIG. 5, in another exemplary embodiment, the apparatus 50 for anchoring a device and/or carrying articles includes a ring structure 52 and at least one container 54. Ring structure 52 includes a tubular body 56, a shaft securing means, such as a retention screw or pin 58, and at least one clip 60 for securing the ring structure to a shaft. The retention screw or pin 58 extends through the ring structure 52 to engage the shaft and secure the apparatus onto the shaft. The retention screw or pin 58 may extend substantially perpendicular to the shaft or may be at an angle away from perpendicular. Preferably the clips 60 include a hinge 62 upon which the clip 60 pivots for opening and closing the clip to secure or release a container 54. In this embodiment, no flange or apertures are necessary on the ring structure 52 as the containers 54 can be clipped onto the ring structure 52. The containers 54 may include loops or extension strings, as shown in the embodiment of FIG. 3, however, such attachment elements are not required, as the material which forms the containers 54 may simply be secured to the ring structure 52 via frictional engagement of the clip 60.

Referring to FIG. 6, another exemplary embodiment of an apparatus 62 for anchoring a device and/or carrying articles is shown including a ring structure 64 and at least one container 66. The ring structure includes a shaft-securing means such as a retention screw or pin 65 for securing the ring structure to a shaft, and a tubular body 68 having at least one hook 69 for securing a respective container 66. In this embodiment, preferably the containers 66 have a loop 67 for fastening onto the hooks 69. The retention screw or pin 65 extends through the ring structure 64 to engage the shaft and secure the apparatus onto the shaft. The retention screw or pin 65 may extend substantially perpendicular to the shaft or may be at an angle away from perpendicular.

Figure 7:
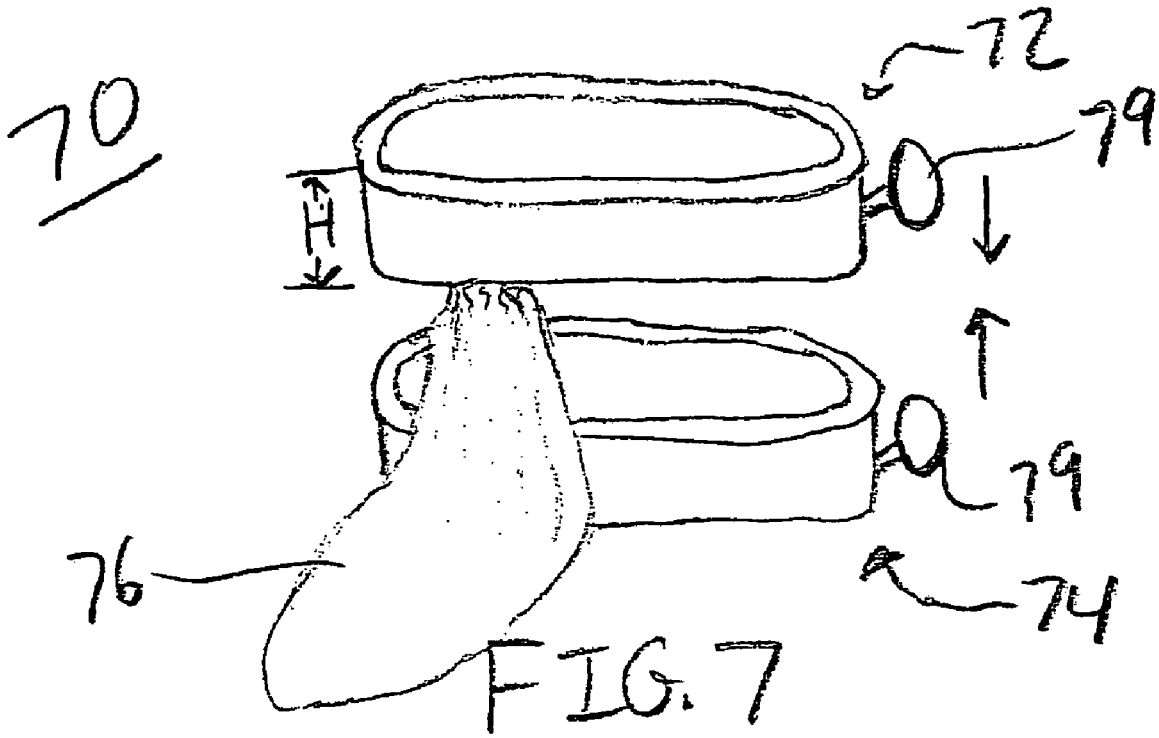
FIG. 7 is an isometric view of an apparatus for anchoring a device or carrying articles according to a further exemplary embodiment.

Referring to FIG. 7, another exemplary embodiment of an apparatus 70 for anchoring a device and/or carrying articles is shown including two rings 72, 74 and at least one container 76. The rings 72, 74 include shaft-securing means for securing the rings to a shaft, such as retention screw 79. In this embodiment, the containers 76 are secured to an article, such as an umbrella shaft or tent pole, for example, by frictional engagement between the two rings 72, 74. Thus, the rings 72, 74 may be slid together, as shown by the arrow, and the containers 76 pressed between them to secure the containers to the shaft or pole. The rings 72, 74 may be secured to the shaft, pole or other structure by retention screws or pins 79, as shown, or by frictional engagement as described above, or by any other means known to those skilled in the art. The retention screw or pin 79 extends through each ring 72, 74 to engage the shaft and secure the apparatus onto the shaft. The retention screw or pin 79 may extend substantially perpendicular to the shaft or may be at an angle away from perpendicular. In this embodiment, preferably the rings 72, 74 have a height H of one inch or less, although heights of greater than an inch are also encompassed.

Figure 8A:
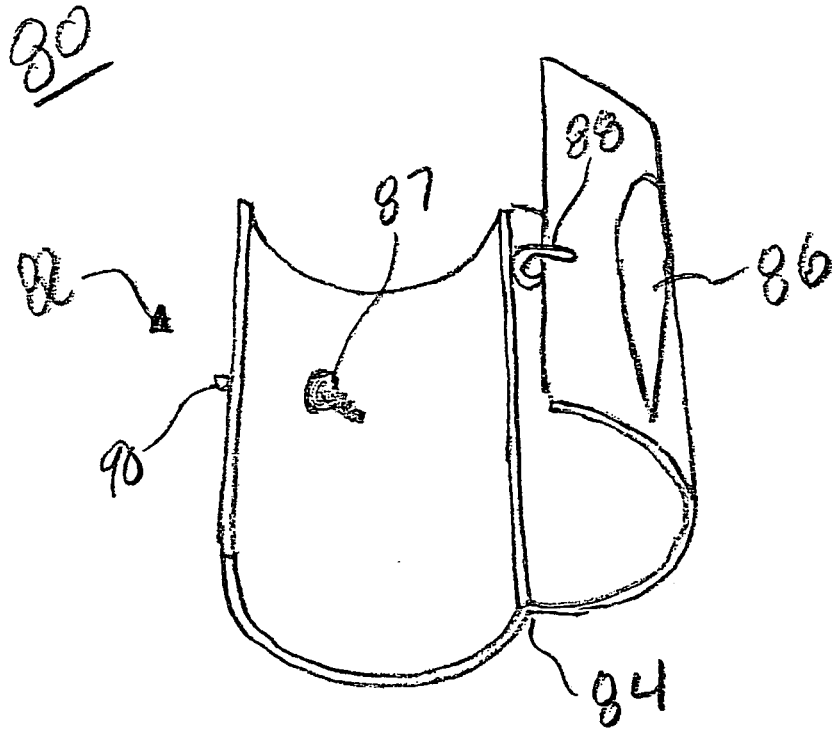
FIG. 8A is an isometric view of a hinged apparatus according to another embodiment shown in an open position.
Figure 8B:
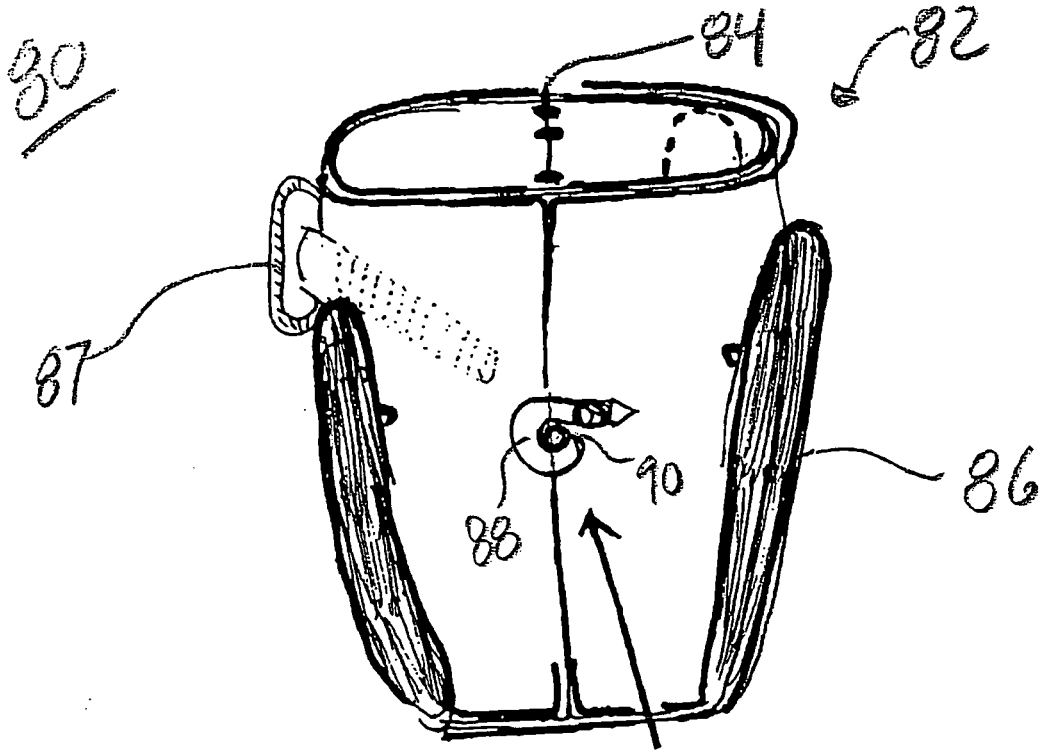
FIG. 8B is an isometric view of the embodiment of FIG. 8A shown in a closed position.

As shown in FIGS. 8A and 8B, another exemplary embodiment of an apparatus 80 for anchoring a device and/or carrying articles is shown comprising a ring structure 82 and at least one container (not shown). The ring structure 82 includes a hinge 84 and container attachment means such as clips 86, as shown in FIGS. 8A and B (the attachment means may also comprise any of the alternative container attachment mechanisms described herein or any other fastener or means of attachment that would be known to one of ordinary skill in the art). The hinge may be a separate piece of hardware or may be a living hinge, such as a flexible portion of material making up the ring structure 82 (as shown in FIG. 8A). Preferably the ring structure 82 also includes shaft-securing means, such as retention screw or pin 87 (as described above) for securing the ring structure to a shaft. Also, preferably, the ring structure 82 includes a ring structure closure means, such as clasp 88 and knob 90 (or any other type of fastener), for locking the ring structure 82 on the shaft or pole. To ensure a tight fit, a compressible gasket (not shown) may be placed between the ring structure 82 and the shaft.

Advantageously, the embodiment shown in FIGS. 8A and 8B allows the apparatus 80 to be used on shafts or poles, or similar devices, which have obstructions that prevent the apparatus 80 from being slid onto the device. For example, apparatus 80 may be employed on umbrella shafts having cranks for opening the umbrella, or on bed posts, strollers or other items which do not allow for installation onto the item by sliding. The hinge 84 on the ring structure 82 allows the ring structure to swing open and closed to encircle devices at any location on the device capable of carrying the apparatus 80.

Although shown having clips and a retention screw, the container attachment means and shaft-securing means may include any fastener or means described herein or which would be known to those skilled in the art, such as Velcro, for example.

In other embodiments, the umbrella shaft may be a unitary structure such that a ring is not required. For example, the ring, having apertures therein, may be an integral part of the umbrella shaft. In some embodiments, the umbrella shaft may be constructed by molding a plastic material, such that the umbrella shaft includes a ring and/or one or more projections from the shaft, having apertures or clips or other container securing means therein for receiving the containers. A plurality of projections substantially in the form of loops may extend from the umbrella shaft, for receiving extensions of the containers. In other embodiments, the shaft may have apertures therein, disposed about the circumference of the shaft, for receiving extensions of the containers. In such embodiments, adjacent pairs of apertures in the forms of holes, slits or the like, can provide for attachment of the containers by threading the extensions therethrough. Materials of which an umbrella shaft including a ring and/or apertures can be made include metal, wood or plastics, especially thermoplastics, such as olefin polymers, styrene plastics, vinyl polymers and acrylics. Specific examples of such materials include polyethylene, polycarbonate, acrylics including polymethyl methacrylate, polyvinyl chloride. Other suitable materials and methods for forming an umbrella shaft having apertures for receiving extensions of containers will be apparent to those skilled in the art.

In other embodiments, a kit may include an umbrella having a shaft and a plurality of containers removably attached to the shaft and capable of anchoring the umbrella. The containers are preferably attached to the umbrella shaft by a ring capable of gripping the shaft. The ring may be made of a deformable material. Alternatively, the ring may have an adjustable inner diameter.

Although the invention has been described in terms of exemplary embodiments, it is not limited thereto. Rather, the appended claims should be construed broadly to include other variants and embodiments of the invention which may be made by those skilled in the art without departing from the scope and range of equivalents of the invention. For example, although shown and described in terms of a substantially circular (or ring) structure for securing around a substantially circular shaft, pole, bar, shank or rod, the apparatus for anchoring a device or for carrying articles may be any shape (or size), such as oval, rectangular or other multisided shape for attachment to a similarly shaped device.

What is claimed is:

1. An apparatus for anchoring a device or carrying articles on a device comprising:

a ring structure having a container holder and a shaft holder, and at least one container attached to the ring structure via the container holder, wherein the container holder is one of the group consisting of at least one clip and at least one portion of a hook and loop fastener.

2. The apparatus of claim 1, wherein each container includes a loop for fastening onto a respective hook of the container holder.

3. An apparatus for anchoring a device or carrying articles on a device comprising:

a ring structure having a container holder and a shaft holder, and at least one container attached to the ring structure via the container holder, wherein the shaft holder is one of the group consisting of a retention screw and a deformable material which comprises the ring structure.

4. An apparatus for anchoring a device or carrying articles on a device comprising:

a ring structure having a container holder and a shaft holder, wherein the ring structure further includes a hinge capable of allowing the ring structure to swing open and closed; and at least one container attached to the ring structure via the container holder.

5. The apparatus of claim 4, wherein the ring structure further includes a ring structure closer.

6. The apparatus of claim 5, wherein the ring structure closer comprises a clasp and a knob.

7. An apparatus for anchoring a device or carrying articles on a device comprising:

first and second rings capable of being secured on a shaft or pole, and a container having at least a portion capable of being secured between the first and second rings, wherein the container is capable of being secured by frictional engagement of the first and second rings.

8. An apparatus for anchoring a device or carrying articles on a device comprising:

first and second rings capable of being secured on a shaft or pole, wherein the first and second rings each include a retention screw or pin for securing the rings onto the shaft or pole, and a container having at least a portion capable of being secured between the first and second rings.

9. An apparatus for anchoring a device or carrying articles on a device comprising:

first and second rings capable of being secured on a shaft or pole, wherein the first and second rings include a hinge capable of allowing the first and second rings to swing open and closed, and a container having at least a portion capable of being secured between the first and second rings.

10. A system for anchoring a device or for carrying articles on a device comprising:

a shaft, a ring structure secured to the shaft and having a container holder,a shaft holder, and a hinge serving as an opening mechanism, and at least one container attached to the ring structure via the container holder.

11. A method for anchoring a device or for carrying articles on a device comprising:

providing a ring structure having a shaft holder and a container holder;

attaching the ring structure to a shaft on the device via the shaft holder, the attaching step comprising opening the ring structure and closing the ring structure around the shaft, and attaching at least one container to the ring structure via the container holder.

12. The method of claim 11, wherein the device is a beach umbrella, a tent, a bed post, a chair or a stroller.

13. The method of claim 11 wherein a hinge on the ring structure allows the ring structure to open and close.

* * * * *